US007971802B2

(12) United States Patent
Male et al.

(10) Patent No.: US 7,971,802 B2
(45) Date of Patent: Jul. 5, 2011

(54) FUEL INJECTOR

(75) Inventors: Andy Male, Walton on Thames (GB); Jonathan N Wray, Cheltenham (GB); Anthony Thomas Harcombe, Richmond (GB); Ricardo Pimenta, Epsom (GB); Malcolm David Dick Lambert, West Wickham (GB); Andrew J Limmer, Edmunds (GB)

(73) Assignee: Delphi Technologies Holding S.arl, Troy, MI (US)

( * ) Notice: Subject to any disclaimer, the term of this patent is extended or adjusted under 35 U.S.C. 154(b) by 339 days.

(21) Appl. No.: 12/150,496

(22) Filed: Apr. 29, 2008

(65) Prior Publication Data

US 2008/0272214 A1 Nov. 6, 2008

(30) Foreign Application Priority Data

May 1, 2007 (EP) ..... 07251827
Feb. 4, 2008 (GB) ..... 0801997.8

(51) Int. Cl.
*F02M 41/16* (2006.01)

(52) U.S. Cl. ..... 239/96; 239/585.5

(58) Field of Classification Search ..... 239/88, 239/89, 91, 95, 96, 533.2, 533.8, 533.9, 533.13, 239/533.14, 585.3, 585.5, 585.1, 584; 251/129, 251/15, 129.15, 129.21, 127
See application file for complete search history.

(56) References Cited

U.S. PATENT DOCUMENTS 5,020,500 A 6/1991 Kelly
5,244,154 A * 9/1993 Buchholz et al. ..... 239/590.3
5,544,816 A * 8/1996 Nally et al. ..... 239/585.5
6,367,453 B1 4/2002 Igashira et al.
6,499,467 B1 12/2002 Morris et al.
6,994,273 B2 2/2006 Ganser et al.
(Continued)

FOREIGN PATENT DOCUMENTS

EP 0135872 4/1985
(Continued)

OTHER PUBLICATIONS

European Search Report dated May 23, 2008.
(Continued)

*Primary Examiner* — Davis Hwu
(74) *Attorney, Agent, or Firm* — Thomas N. Twomey

(57) ABSTRACT

A fuel injector comprising a nozzle having a nozzle needle which is moveable with respect to a first needle seat to control fuel delivery through a nozzle outlet. The injector includes a nozzle control valve for controlling fuel flow into a control chamber through a first passage to pressurise the control chamber, and for controlling fuel flow out of said control chamber through said first passage to depressurise the control chamber. Movement of the nozzle needle is controlled by fuel pressure within the control chamber, such that pressurising the control chamber causes the nozzle needle to be urged against the first needle seat to close the nozzle outlet, and depressurising the control chamber causes the nozzle needle to lift from the first needle seat to open the nozzle outlet. The nozzle needle defines, at least in part, a restricted passage through which fuel can flow into the control chamber as the control chamber depressurises. The fuel flow into the control chamber through the restricted passage serves to reduce the rate at which the control chamber depressurises, thereby reducing the rate at which the nozzle needle lifts from the first needle seat to open the nozzle outlet.

18 Claims, 7 Drawing Sheets

U.S. PATENT DOCUMENTS

| | | | |
|---|---|---|---|
| 2006/0186227 | A1 | 8/2006 | Augustin |

FOREIGN PATENT DOCUMENTS

| | | |
|---|---|---|
| JP | HEI9-60565 | 3/1997 |
| JP | 2001-355534 | 12/2001 |
| JP | 2003-28020 | 1/2003 |
| JP | 2005-529264 | 9/2005 |
| WO | 2004/005702 | 1/2004 |
| WO | 2005/085624 | 9/2005 |
| WO | 2006/091429 | 8/2006 |

OTHER PUBLICATIONS

Japan Office Action dated Jun. 30, 2010.

* cited by examiner

FUEL INJECTOR

TECHNICAL FIELD

The invention relates to a fuel injector for use in the delivery of fuel to a combustion space of an internal combustion engine, and particularly to a fuel injector suitable for delivering small quantities of fuel across a wide range of fuel pressures.

BACKGROUND TO THE INVENTION

To optimise diesel engine combustion, it is necessary to have precise control over the quantities of fuel delivered by the fuel injectors. It is desirable to be able to inject small quantities of fuel across a wide range of fuel pressures. For heavy-duty applications in particular, the fuel injectors must be capable of delivering fuel in small quantities at very high fuel pressures.

Typically, a fuel injector includes an injection nozzle having a nozzle needle which is movable towards and away from a nozzle needle seating so as to control fuel injection into the engine. The nozzle needle is controlled by means of a nozzle control valve (NCV), which controls fuel pressure in a control chamber for the nozzle needle.

Small and controllable injection quantities can be achieved by reducing the opening rate of the nozzle needle whilst maintaining a high closing rate. One way of achieving an asymmetric opening and closing characteristic is to modify the NCV to define a restricted flow path for fuel flow between the control chamber and a low pressure drain as described in WO 2004/005702.

Adapting the NCV described in WO 2004/005702 for use in high-pressure applications can be problematic because of the configuration of the NCV which is necessary to provide the restricted flow path. It is therefore an object of this invention to provide a fuel injector which is suitable for use at high pressures, and which has a desirable asymmetric opening and closing characteristic, but which can be used with any type of NCV, including a standard, unrestricted NCV.

SUMMARY OF THE INVENTION

The invention provides a fuel injector for use in delivering fuel to an internal combustion engine, the fuel injector comprising a nozzle having a nozzle needle which is moveable with respect to a first needle seat to control fuel delivery through a nozzle outlet, and a nozzle control valve for controlling fuel flow into a control chamber through a first passage to pressurise the control chamber, and for controlling fuel flow out of said control chamber through said first passage to depressurise the control chamber whereby movement of the nozzle needle is controlled by fuel pressure within the control chamber, such that pressurising the control chamber causes the nozzle needle to be urged against the first needle seat to close the nozzle outlet, and depressurising the control chamber causes the nozzle needle to lift from the first needle seat to open the nozzle outlet. The nozzle needle defines, at least in part, a restricted passage through which fuel can flow into the control chamber as the control chamber depressurises, the fuel flow into the control chamber through said restricted passage serving to reduce the rate at which the control chamber depressurises, thereby reducing the rate at which the nozzle needle lifts from the first needle seat to open the nozzle outlet.

The restricted passage may also allow fuel flow into the control chamber during pressurisation of the control chamber so as to increase the rate at which the control chamber pressurises, thereby increasing the rate at which the nozzle needle is urged against the first needle seat to close the nozzle outlet.

The fuel injector may include a second needle seat with which the nozzle needle engages when the nozzle needle lifts from the first needle seat to its maximum extent, engagement of the nozzle needle with the second needle seat closing the restricted passage to substantially prevent fuel flow into the control chamber through the restricted passage, thereby reducing parasitic losses of fuel during fuel delivery.

The fuel may be supplied to the injector nozzle through a supply passage. The restricted passage may provide communication between the supply passage and the control chamber.

An upper end of the nozzle needle, remote from nozzle outlet, may be slidable within a bore in an injector body, and the restricted passage is defined in part by an outer surface of the upper end of the nozzle needle, and in part by a surface of the bore.

In one embodiment of the invention, the restricted passage is defined in part by a substantially flat portion of the outer surface of the upper end of the nozzle needle. The restricted passage may further be defined in part by the surface of the bore. In an alternative embodiment of the invention, the restricted passage may be defined by an orifice provided in the nozzle needle which, in one embodiment, may include an axial drilling and a radial/lateral drilling.

Still alternatively, the restricted passage may be substantially annular in cross section and, in one embodiment, may have a flow area that increases as the pressure of fuel supplied to the injector nozzle increases. The nozzle needle may be resiliently deformable to vary the size of the restricted passage with the pressure of fuel supplied to the injector nozzle. The upper end of the nozzle needle may be resiliently deformable, and arranged to contract inwardly to increase the size of the restricted passage when the fuel pressure supplied to the injector nozzle exceeds the pressure in the control chamber.

In a further embodiment of the invention a cavity may be provided in the upper end of the nozzle needle for reducing the structural rigidity of said upper end. The cavity may be defined by a resiliently deformable cavity wall. The cavity wall may be arranged to contract inwardly when the fuel pressure in control chamber is reduced.

An additional restricted passage may be provided between the control chamber and a region outside the cavity wall. The additional restricted passage may be arranged such that, in use, fuel can flow out of the control chamber during pressurisation of the control chamber into the region outside the cavity wall. This fuel flow allows the pressure on either side of the cavity wall to equalise, and hence limits radial expansion of the cavity wall as the control chamber is pressurised. The additional restricted passage may have a fixed flow area. The additional restricted passage may be defined, at least in part, by the nozzle needle.

Furthermore, the additional restricted passage may be defined in part by a substantially flat portion of an outer surface of the upper end of the nozzle needle.

BRIEF DESCRIPTION OF THE DRAWINGS

In order that the invention may be more readily understood, reference will now be made by way of example to the accompanying drawings in which.

DETAILED DESCRIPTION OF PREFERRED EMBODIMENTS

Figure 1:
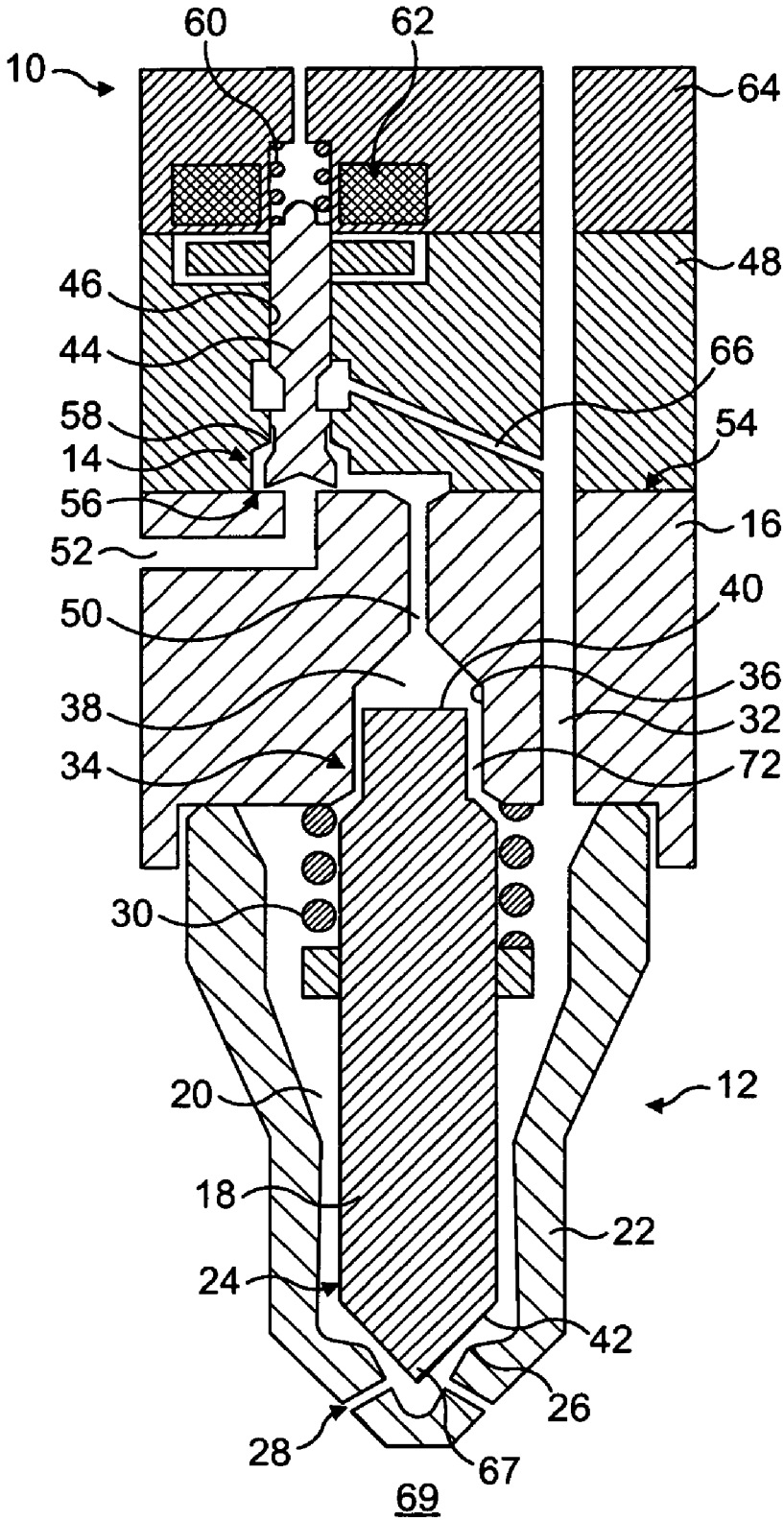
FIG. 1 is a schematic cross-sectional view of a fuel injector according to a first embodiment of the invention.

FIG. 1 is a schematic cross-sectional view of a fuel injector 10 for use in delivering fuel to an engine cylinder or other combustion space of an internal combustion engine. The fuel injector 10 comprises an injector nozzle 12 and a three-way nozzle control valve (NCV) 14. An injector body 16 connects the injector nozzle 12 and the NCV 14.

The nozzle 12 comprises a nozzle needle 18 that is slidable within a nozzle chamber 20 defined within a nozzle body 22. A lower end 24 of the nozzle needle 18 terminates in a nozzle tip 67 and is engageable with a first needle seat 26 defined by the nozzle body 22 so as to control fuel delivery through a set of outlet openings 28 provided in the nozzle body 22 into a combustion space 69. The nozzle 12 includes a spring 30 for biasing the nozzle needle 18 towards the first needle seat 26. Fuel under high pressure is delivered from a fuel supply to the nozzle chamber 20, in use, through a supply passage 32 defined, in part, within the injector body 16.

An upper end 34 of the nozzle needle 18, remote from the outlet openings 28, is slidable within a cylindrical guide bore 36 in the injector body 16. The upper end 34 is also referred to as the "needle piston". It should be understood that the terms 'upper' and 'lower' are used for convenience, and refer to the orientation of the injector 10 as illustrated in the drawings; these terms are not intended to limit the scope of the invention or imply any limitations on the actual orientation of the injector 10 in use.

A control chamber 38 is located axially in line and above the nozzle needle 18 in the orientation shown in FIG. 1. The control chamber 38 is defined in part by the cylindrical guide bore 36 and in part by an end surface 40 of the upper end 34 of the nozzle needle 18. Fuel pressure within the control chamber 38 applies a force to the end surface 40 of the nozzle needle 18, which serves to urge the nozzle needle 18 against the first needle seat 26 to prevent fuel injection through the outlet openings 28.

In use, with high pressure fuel supplied to the nozzle chamber 20 through the supply passage 32, a force is applied to a thrust surface 42 of the nozzle needle 18 which serves to urge the nozzle needle 18 away from the first needle seat 26. If fuel pressure within the control chamber 38 is reduced sufficiently, the force acting on the thrust surface 42 due to fuel pressure within the nozzle chamber 20 in addition to the force from the gas pressure in the combustion chamber 69 acting on the needle tip 67, is sufficient to overcome the force acting on the end surface 40 of the nozzle needle 18, and the force on the nozzle needle 18 provided by the spring 30 (the spring pre-load force), such that the nozzle needle 18 lifts away from the first needle seat 26 to commence fuel injection. Thus, by controlling fuel pressure within the control chamber 38, initiation and termination of fuel injection can be controlled.

The pressure of fuel within the control chamber 38 is controlled by means of the NCV 14. The NCV 14 includes an NCV pin 44 which is slidable within an NCV guide bore 46 defined in an NCV housing 48. The NCV housing 48 abuts the injector body 16. The injector body 16 is provided with a first drilling which defines a first flow passage 50 in communication with the control chamber 38, and a second drilling which defines a second flow passage 52 in communication with a low pressure fuel reservoir or drain.

An upper end face 54 of the injector body 16 defines a first NCV seat 56 with which an end of the NCV pin 44 is engaged when the NCV pin 44 is moved into a first position. The NCV guide bore 46 is shaped to define a second NCV seat 58 with which a surface of the NCV pin 44 is engaged when the NCV pin 44 is moved into a second position. Conveniently, the NCV pin 44 is biased into engagement with the first NCV seat 56 by means of a spring 60 or other biasing arrangement. Movement of the NCV pin 44 is controlled by means of an electromagnetic actuator arrangement 62 housed within an actuator housing 64. The actuator housing 64 abuts the NCV housing 48, both housings 48, 64 being provided with drillings which form part of the supply passage 32 to the nozzle chamber 20. The NCV housing 48 also defines an intermediate passage 66 which connects the supply passage 32 with the NCV guide bore 46.

It should be appreciated at this point that although an electromagnetic actuator is described, the NCV pin 44 may also be controlled by other means, for example a piezoelectric actuator or a magnetorestrictive actuator.

In use, when the NCV 14 is de-actuated, that is when the NCV pin 44 is in its first position such that the end of the NCV pin 44 is in engagement with the first NCV seat 56, fuel at high pressure is able to flow from the supply passage 32 through the intermediate passage 66 defined in the NCV housing 48, past the second NCV seat 58 and through the first flow passage 50 into the control chamber 38 thereby pressurising the control chamber 38. In such circumstances, the nozzle needle 18 is urged against the first needle seat 26 because the net downward force on the nozzle needle 18 provided by the pressurised fuel in the control chamber 38 acting on the end surface 40 of the nozzle needle 18, in combination with the spring pre-load force, is greater than the net upward force on the nozzle needle 18 provided by the pressurised fuel in the nozzle chamber 20 acting on the thrust surface 42 of the nozzle needle 18 in combination with the force exerted on the nozzle needle tip 67 by pressurised gas in the combustion space 69. Thus, fuel injection through the outlet openings 28 does not occur. It should be appreciated that the terms 'downward' and 'upward' relate only to the orientation of the injector as shown in the drawings and should not imply any limitation on the orientation of the injector in use.

When the NCV 14 is actuated, that is when the NCV pin 44 is moved away from the first NCV seat 56 into engagement with the second NCV seat 58, fuel within the supply passage 32 is no longer able to flow past the second NCV seat 58 to the control chamber 38. Instead, fuel within the control chamber 38 is able to flow through the first flow passage 50, past the first NCV seat 56 and through the second flow passage 52 to the low pressure fuel reservoir. Fuel pressure within the control chamber 38 is therefore reduced or, in other words, the control chamber 38 is depressurised. As a result, the nozzle needle 18 is urged away from the first needle seat 26 due to the force of fuel pressure within the nozzle chamber 20 acting on the thrust surface 42 of the nozzle needle 18 being sufficient to overcome the reduced force acting on the end surface 40 of the nozzle needle 18 and the spring pre-load force.

Figure 2:
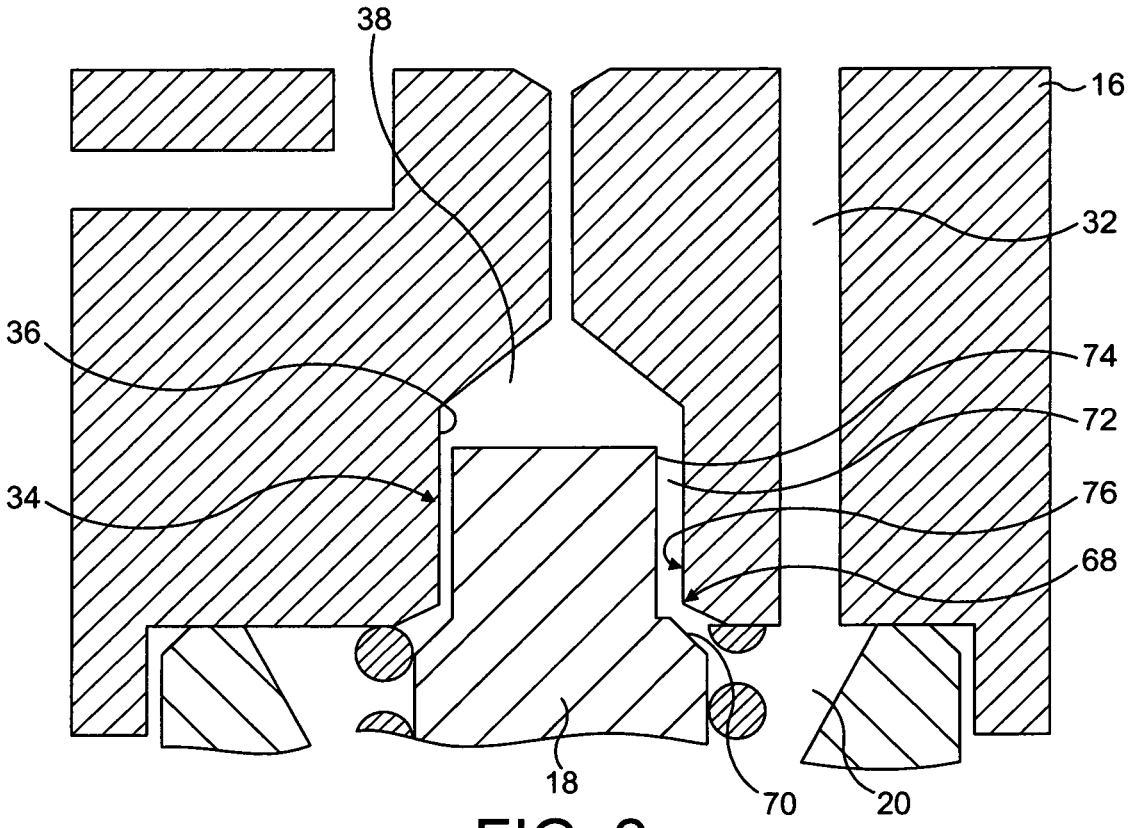
FIG. 2 is an enlarged view of part of the fuel injector of FIG. 1.

Referring now to FIG. 2, which is an enlarged view of the injector body 16 showing the upper end 34 of the nozzle needle 18 and the control chamber 38, it can be seen that the guide bore 36 in the injector body 16 is shaped to define a second needle seat 68 for engaging a frusto-conical surface 70 provided by a shoulder defined towards a base of the upper end 34 of the nozzle needle 18. The second needle seat 68 provides a stop that limits the maximum extent to which the nozzle needle 18 can lift from the first needle seat 26 (FIG. 1) during fuel injection.

Figure 3A:
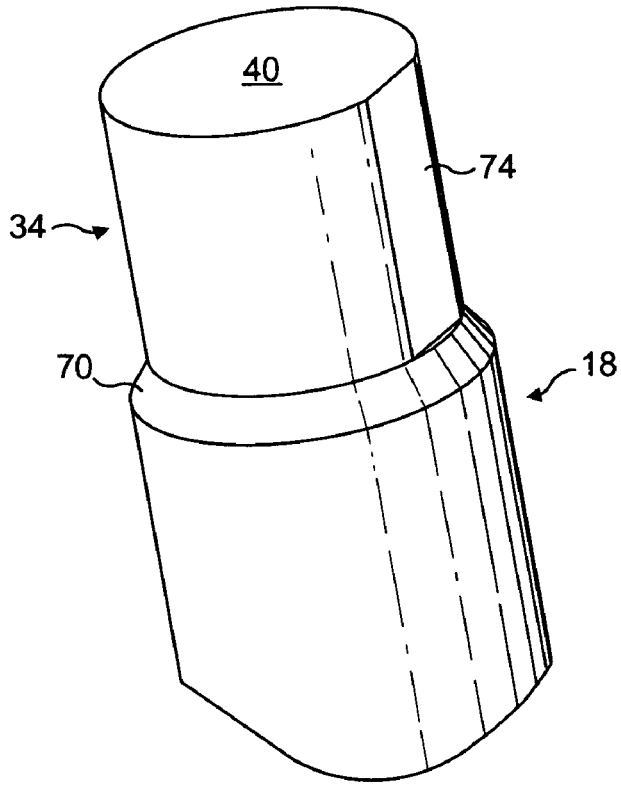
FIG. 3*a* is a perspective view of part of a nozzle needle of the fuel injector shown in FIGS. 1 and 2.

A restricted passage 72 extends between the control chamber 38 and the nozzle chamber 20. The restricted passage 72 is defined in part by a flat portion 74 of the external surface of the upper end 34 of the nozzle needle 18, and in part by the cylindrical surface 76 of the guide bore 36 in the injector body 16. The flat portion 74 is best seen in FIG. 3*a*, which is a perspective view of the upper end 34 of the nozzle needle 18.

Figure 3B:
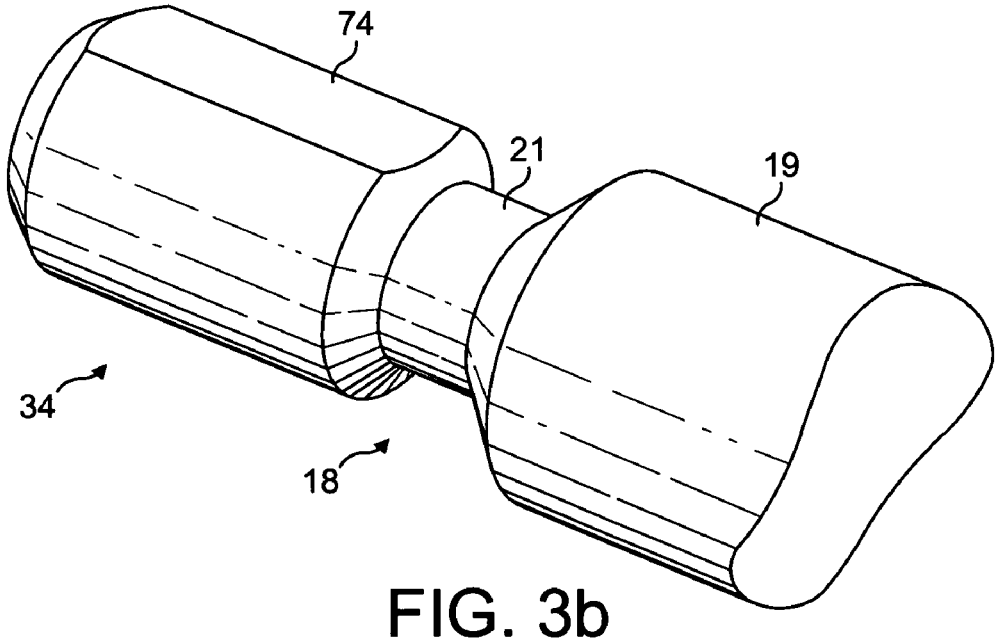
FIG. 3*b* is a perspective view of part of an alternative embodiment of a nozzle needle which is suitable for use in the fuel injector shown in FIGS. 1 and 2.

FIG. 3*b* shows an upper end 34 of an alternative embodiment of nozzle needle 18 suitable for use in the injector of FIGS. 1 and 2. In this embodiment, the upper end 34 also contains a flat portion 74 which partly defines the restricted flow passage 72, but in this case the upper end 34 is spaced from but connected to the main body 19 of the nozzle needle 18 by a neck portion 21 of reduced diameter.

Referring now to FIGS. 1 to 3(*a*), in use the restricted passage 72 provides a restricted flow path along which fuel from the supply passage 32 flows into the control chamber 38 during a nozzle opening phase, that is when the nozzle needle 18 is caused to lift away from the first needle seat 26 (FIG. 1) to commence injection of fuel through the nozzle outlets 28. This flow of fuel into the control chamber 38 through the restricted passage 72 results in a reduced net flow rate out of the control chamber 38, and hence a reduced rate of pressure loss in the control chamber 38. The reduced rate of pressure loss in the control chamber 38 in turn results in a reduced rate of needle lift during the nozzle opening phase.

When the nozzle needle 18 lifts to its maximum extent, that is, when the nozzle outlets 28 are fully open and fuel injection is taking place, the frusto-conical surface 70 of the nozzle needle 18 engages the second needle seat 68 to close the restricted passage 72. This prevents losses of pressurised fuel through the restricted passage 72 to the low pressure drain when injection is taking place at full needle lift. The purpose of this is to reduce leakage of high pressure fuel, thereby reducing energy losses and hence improving the overall efficiency of the engine.

During a nozzle closing phase, that is, when the NCV 14 is de-actuated so that the first NCV seat 56 is closed and the second NCV seat 58 is open, so as to close the injector nozzle outlets 28 and terminate injection, fuel flows from the supply passage 32, past the second NCV seat 58 and into the control chamber 38 through the first flow passage 50 causing the nozzle needle 18 to move towards the first needle seat 26. When the nozzle needle 18 begins to move, the frusto-conical surface 70 of the nozzle needle 18 moves out of engagement with the second needle seat 68, causing the restricted passage 72 to open again. High pressure fuel in the nozzle chamber 20 then enters the control chamber 38 through the restricted passage 72, in addition to the fuel which is entering the control chamber 38 via the first flow passage 50. This causes a rapid equalisation of pressure between the control chamber 38 and the nozzle chamber 20 during the nozzle closing phase. The spring 30 then provides the force to close the nozzle without any hydraulic retarding force. This results in a rapid termination of fuel injection and hence a desirable asymmetric nozzle needle lift profile.

Figure 4:
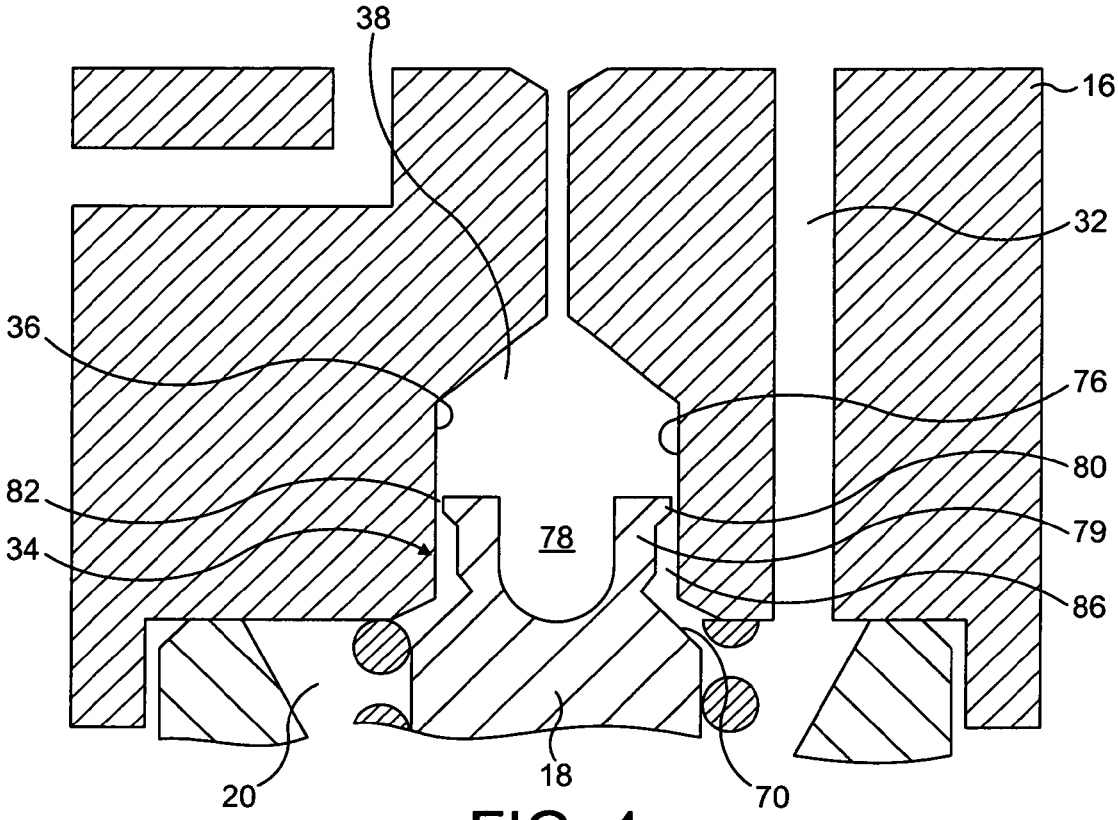
FIG. 4 is a schematic cross-sectional view of a fuel injector according to a second embodiment of the invention.

Referring now to FIG. 4, this shows a second embodiment of the invention in which equivalent features have the same reference numerals as FIG. 1. The upper end 34 of the nozzle needle 18 differs to that of the first embodiment, although the rest of the injector is substantially the same as the injector 10 shown in FIG. 1. In this second embodiment shown in FIG. 4, a section of material at the upper end 34 of the nozzle needle 18 has been removed to provide a cavity 78 in the nozzle needle 18 that is defined by a cavity wall 79. The cavity 78 serves to reduce the structural rigidity of the upper end 34 of the nozzle needle 18. The upper end of the cavity wall 79 includes a circular lip 80 that protrudes radially outwards from around the outer circumference of the cavity wall 79. The circular lip 80, together with the cylindrical surface 76 of the guide bore 36, define a restricted passage 82 between the nozzle chamber 20 and the control chamber 38 via a chamber 86 defined between the upper end 34 of the nozzle needle 18 and the guide bore 36. The restricted passage 82 has a substantially annular cross-section and provides a restricted flow path along which fuel delivered to the nozzle chamber 20 through the supply passage 32 can flow into the control chamber 38.

Figure 5:
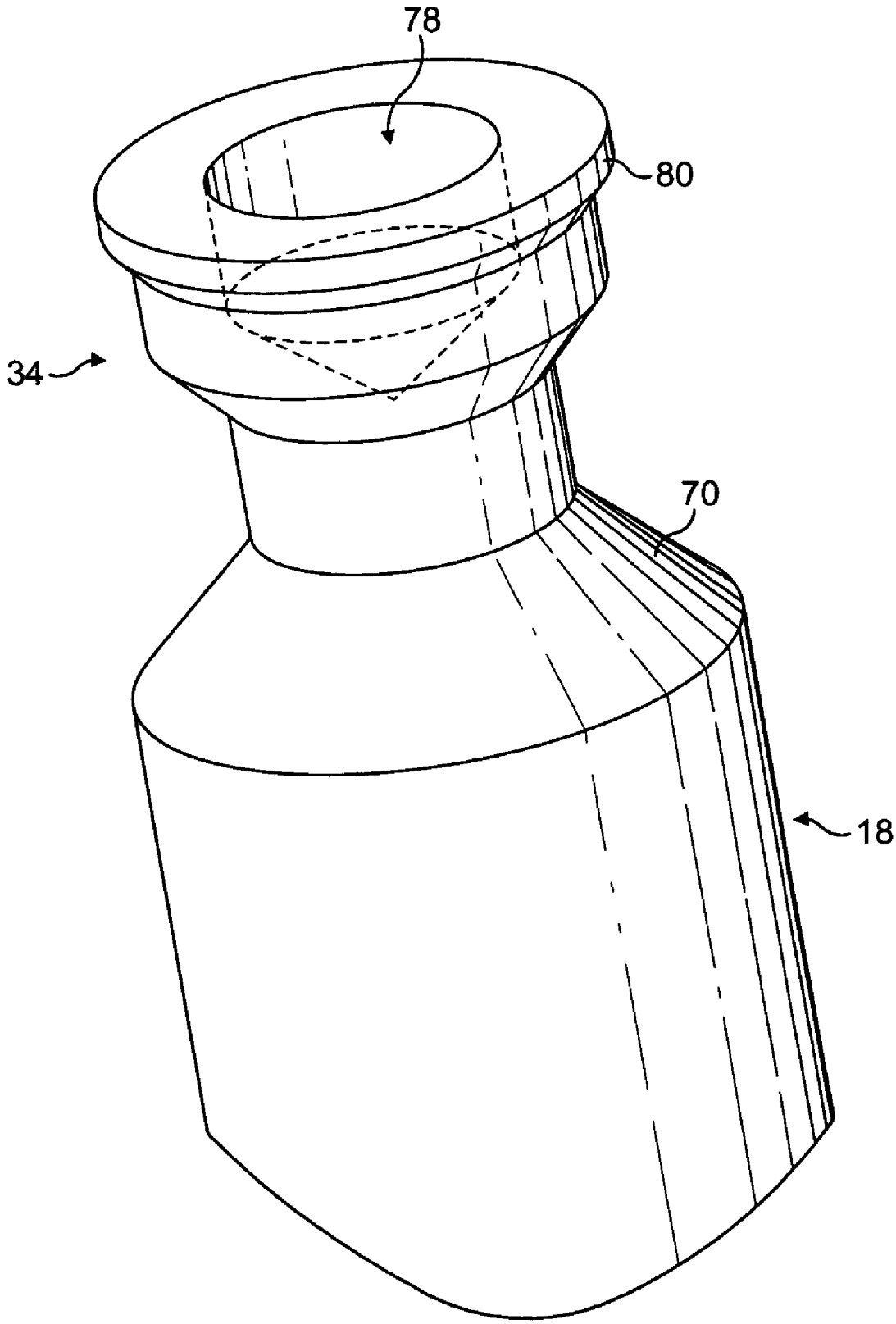
FIG. 5 is a perspective view of part of a nozzle needle of the fuel injector shown in FIG. 4.

FIG. 5 is a schematic perspective view showing the upper end 34 of the nozzle needle 18, in which dashed lines indicate the cavity 78.

Referring again to FIG. 4, during a nozzle opening phase, that is, when fuel pressure in the control chamber 38 is reduced such that the nozzle needle 18 lifts from the first needle seat 26 (FIG. 1), the fuel pressure in the nozzle chamber 20 is greater than the fuel pressure in the control chamber 38. As a consequence of the reduced structural rigidity at the upper end 34 of the nozzle needle 18 due to the presence of the cavity 78, the lip 80 is provided with a degree of radial flexibility such that the pressure differential across the restricted annular passage 82 causes the cavity wall 79 to deform resiliently by contracting radially inwards. This radial contraction results in an increase in the annular clearance between the circular lip 80 and the guide bore 36 in the injector body 16, and hence an increase in flow area between the nozzle chamber 20 and the control chamber 38 provided by the restricted annular passage 82.

The supply pressure, that is the pressure of fuel supplied to the nozzle chamber 20 via the supply passage 32, is variable depending upon the engine operating requirements. At high supply pressures, fuel is delivered through the nozzle outlets 28 (FIG. 1) at a very high rate, and it is therefore desirable to be able to reduce the rate at which the nozzle needle 18 lifts from the first needle seat 26 (FIG. 1) as the supply pressure increases so that small quantities of fuel can be delivered through the nozzle outlets 28 even at high supply pressures. To achieve this, the restricted annular passage 82 is designed to increase in flow area as the supply pressure increases so as to allow more fuel into the control chamber 38 thereby reducing the rate of needle lift. Specifically, the annular clearance between the circular lip 80 and the guide bore 36 increases with increasing supply pressure because the increased fuel pressure in the nozzle chamber 20 results in an increased pressure differential across the restricted annular passage 82, which in turn results in an increased radial contraction of the cavity wall 79.

The diameter of the upper end 34 of the nozzle needle 18 is such that the clearance between the circular lip 80 and the guide bore 36 is minimal at low supply pressures when there is a reduced pressure differential across the restricted annular passage 82. The flow area provided by the restricted annular passage 82 is therefore minimal for low supply pressures. This ensures that the force acting on the thrust surface 42

(FIG. 1) of the nozzle needle 18 is sufficient to lift the nozzle needle 18 even for low supply pressures. The minimum supply pressure required to lift the nozzle needle 18 and thereby open the nozzle outlets 28 (FIG. 1) is therefore relatively low. For example, the fuel pressure produced at engine cranking or idle conditions is sufficient to lift the nozzle needle 18.

Depending upon the precise geometry of the nozzle needle 18, and the particular pressures involved, a potential problem may arise with such a passively varying restricted annular passage 82 during nozzle closing, that is when the control chamber 38 is pressurised to force the nozzle needle 18 down against the first needle seat 26. When the control chamber 38 is pressurised, the fuel pressure within the cavity 78 in the upper end 34 of the nozzle needle 18 will be greater than that in the nozzle chamber 20. This may cause the cavity wall 79 to expand, or dilate, radially outwards, closing the restricted annular passage 82 and potentially causing a high contact force between the cavity wall 79 and the guide bore 36 in the injector body 16.

Figure 6:
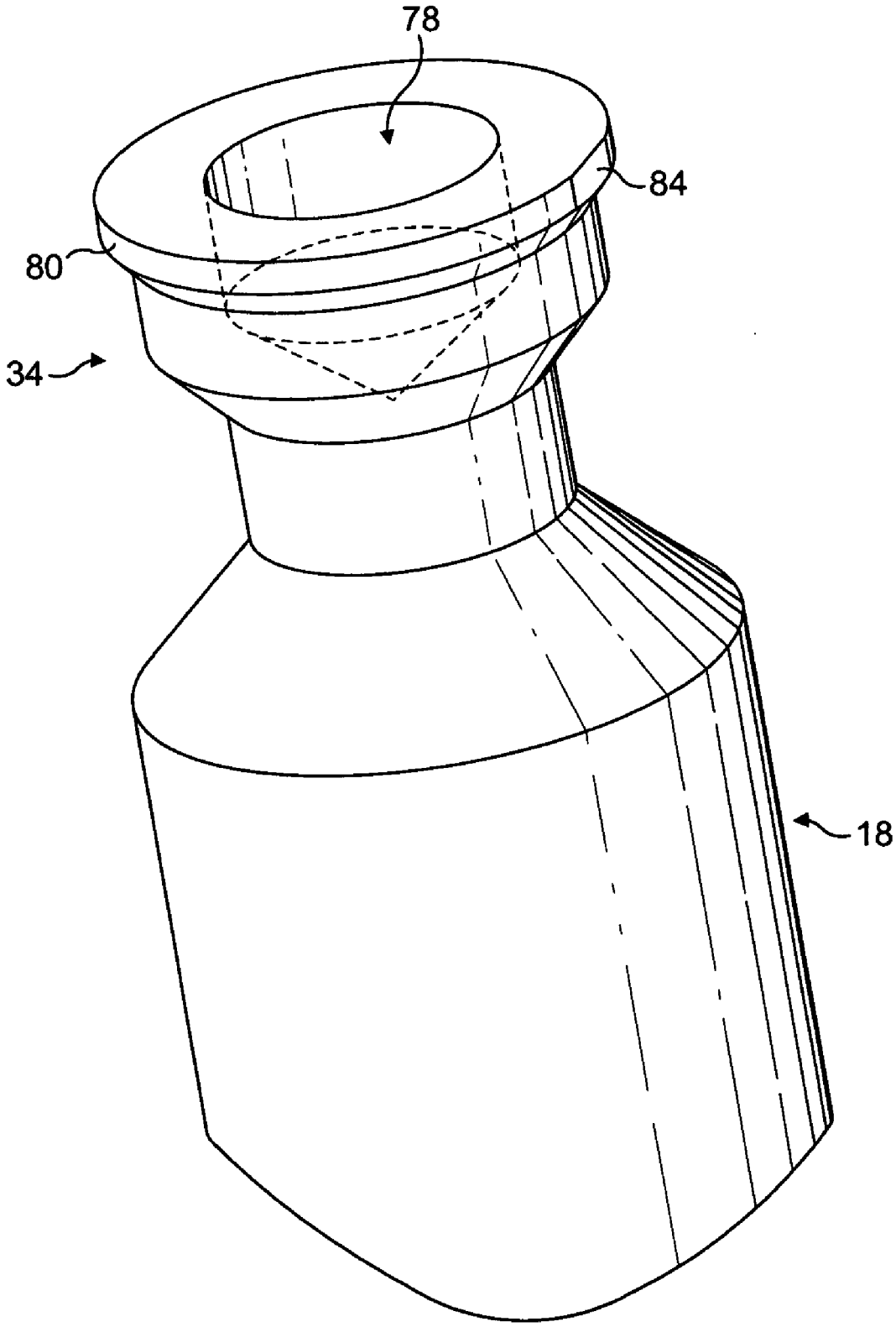
FIG. 6 is a perspective view of an alternative nozzle needle suitable for use in the fuel injector of FIG. 4.

The problem described above can be overcome by the provision of an additional restricted passage between the control chamber 38 and the nozzle chamber 20 which provides an additional restricted flow path along which fuel can flow out of control chamber 38 as the control chamber 38 is pressurised, thereby limiting the pressure which can build up within the cavity 78. FIG. 6 shows the upper end 34 of a nozzle needle 18 that is adapted to provide such an additional restricted passage. The circular lip 80 has been provided with a flat portion 84 that, together with the cylindrical surface 76 of the guide bore 36, defines the additional restricted passage between the control chamber 38 and the nozzle chamber 20. The additional restricted passage has a fixed flow area, that is, a flow area that remains substantially constant as the supply pressure varies.

During nozzle closing, that is when fuel flows past the second NCV seat 58 (FIG. 1) into the control chamber 38 through the first flow passage 50 to pressurise the control chamber 38, some fuel will also flow out of the control chamber 38, through the additional restricted passage defined between the flat portion 84 and the guide bore 36, and into a chamber 86 (FIG. 4) between the circular lip 80 and the frusto-conical surface 70. The additional restricted passage permits the pressure to equalise between the chamber 86 and the control chamber 38, and hence limits the expansion of the cavity wall 79. In this way, the additional restricted passage substantially prevents high contact forces between the cavity wall 79 of the nozzle needle 18 and the guide bore 36.

Figure 7:
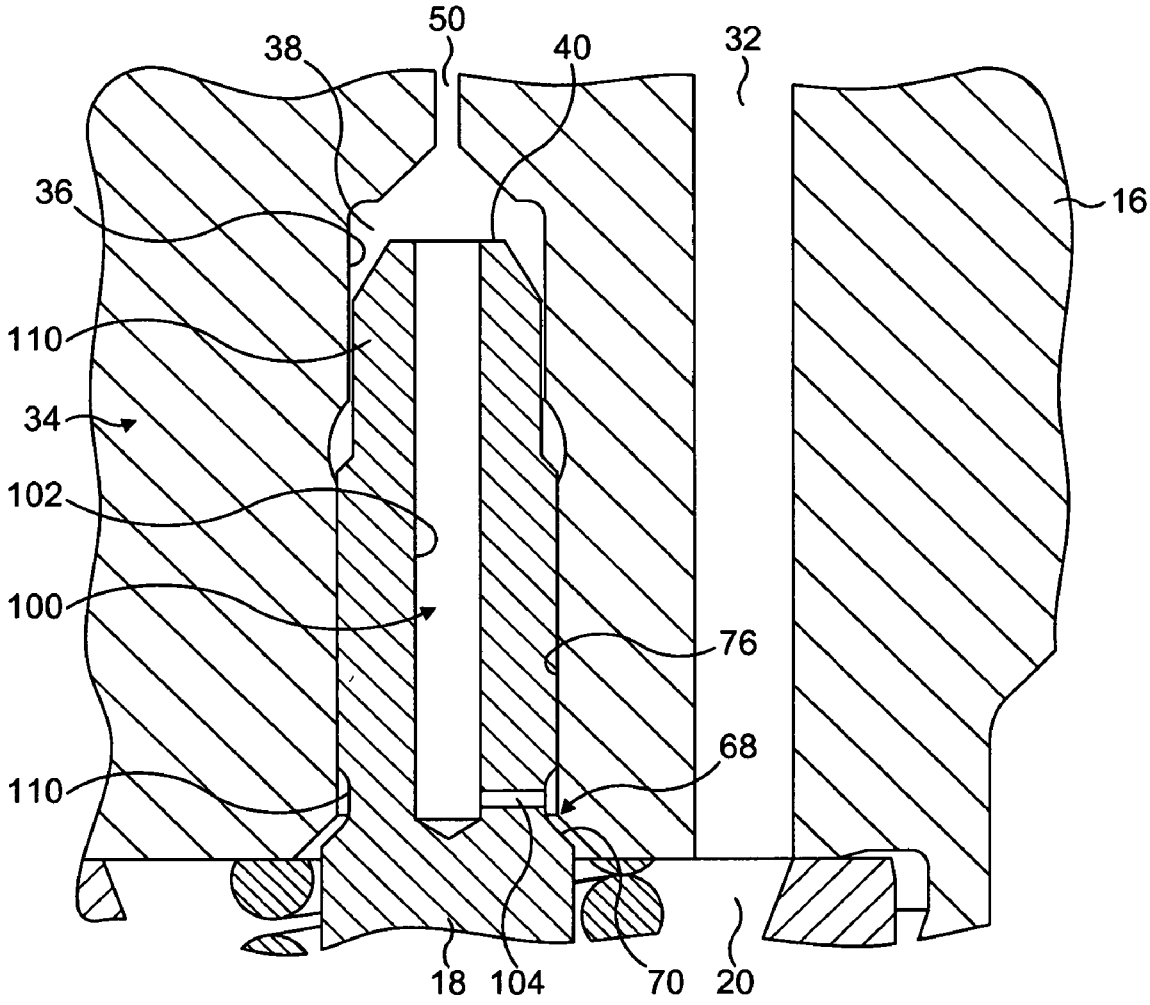
FIG. 7 is a schematic cross-sectional view of a fuel injector according to a third embodiment of the invention.

FIG. 7 shows a further alternative embodiment of the invention in which equivalent features are denoted by the same reference numerals as in FIGS. 1 and 2.

In this embodiment, instead of a restricted passage being defined by the outer periphery of the nozzle needle 18, the restriction to fuel flow is provided by a flow path 100 in the form of an orifice defined in the upper end 34 of the nozzle needle 18.

The restricted flow path 100 includes a blind drilling 102 that extends axially from the end surface 40 of the upper end 34 of the nozzle needle 18 and terminates at the base of the upper end 34, which is in the general vicinity of the second seating surface 68 defined by the guide bore 36 of the injector body 16. The flow path 100 also includes a restricted drilling 104 which extends radially from the blind end of the axial drilling 102 and exits into an annular recess 106 defined at the base of the upper end 34.

The annular recess 106 provides a clearance between the upper end 34 of the nozzle needle 18 and the lower end of the guide bore 36 such that when the nozzle needle 18 is in a position in which the frusto-conical surface 70 is spaced away from the second needle seat 68 fuel can flow past the second seating surface 68 into the radial drilling 104 and, thus, into the axial drilling 102 at a restricted rate. From the axial drilling 102, fuel is able to flow unimpeded through the control chamber 38 and the flow passage 50 and, hence, to the low pressure drain passage.

As shown in the embodiment in FIG. 7, the upper end 34 tapers slightly into a generally cylindrical tip section 110, the diameter of which is less than that of the guide bore 36 such that a clearance of approximately 0.125 mm is defined therebetween. However, it should be appreciated that this dimension is not essential to the invention.

As can be appreciated from FIG. 7, since the flow restriction is defined by the radial drilling 104 of the nozzle needle 18, and not by a feature defined in the outer surface of the nozzle needle 18 (for example a flute, groove or flat), the nozzle needle 18 is guided by close contact between its upper end 34 and the cylindrical surface 76 of the guide bore 36. Advantageously, this embodiment provides the ability to manufacture the geometry of the drillings 102, 104 to achieve a precisely controlled flow, for example by honing the drillings until a desired flow rate is achieved. This may produce a more accurate predetermined flow rate than the alternative of manufacturing the nozzle needle 18 with a flat of a predetermined dimension which may not yield exactly the flow rate that is desired. Furthermore, part-to-part variation can be reduced in this way.

The present invention may be implemented in a common rail injector, in which a common supply (rail) delivers fuel to at least two injectors of the engine, or may be implemented in an electronic unit injector (EUI) in which each injector of the engine is provided with its own dedicated pump and, hence, high pressure fuel supply. The invention may also be implemented in a hybrid scheme, having dual common rail/EUI functionality.

The invention claimed is:

1. A fuel injector for use in delivering fuel to an internal combustion engine, the fuel injector comprising:

a nozzle having a nozzle needle which is moveable with respect to a first needle seat to control fuel delivery through a nozzle outlet;

a nozzle control valve for controlling fuel flow into a control chamber through a first passage to pressurise the control chamber, and for controlling fuel flow out of said control chamber through said first passage to depressurise the control chamber;

a second needle seat with which the nozzle needle engages when the nozzle needle lifts from the first needle seat to its maximum extent;

whereby movement of the nozzle needle is controlled by fuel pressure within the control chamber, such that pressurising the control chamber causes the nozzle needle to be urged against the first needle seat to close the nozzle outlet, and depressurising the control chamber causes the nozzle needle to lift from the first needle seat to open the nozzle outlet;

wherein the nozzle needle defines, at least in part, a restricted passage through which fuel can flow into the control chamber as the control chamber depressurises, the fuel flow into the control chamber through said restricted passage serving to reduce the rate at which the control chamber depressurises, thereby reducing the rate at which the nozzle needle lifts from the first needle seat to open the nozzle outlet; and wherein engagement of the nozzle needle with the second needle seat closes the restricted passage to substantially prevent fuel flow into the control chamber through the restricted passage, thereby reducing parasitic losses of fuel during fuel delivery.

2. The injector of claim 1, wherein the restricted passage allows fuel to flow into the control chamber during pressurisation of the control chamber so as to increase the rate at which the control chamber pressurises, thereby increasing the rate at which the nozzle needle is urged against the first needle seat to close the nozzle outlet.

3. The injector of claim 1, wherein fuel is supplied to the injector nozzle through a supply passage, and the restricted passage provides communication between the supply passage and the control chamber.

4. The injector of claim 1, wherein an upper end of the nozzle needle, remote from nozzle outlet, is slidable within a bore in an injector body, and the restricted passage is defined in part by an outer surface of the upper end of the nozzle needle, and in part by a surface of the bore.

5. The injector of claim 4, wherein the restricted passage is defined in part by a substantially flat portion of the outer surface of the upper end of the nozzle needle, and in part by the surface of the bore.

6. A fuel injector for use in delivering fuel to an internal combustion engine, the fuel injector comprising:

a nozzle having a nozzle needle which is moveable with respect to a first needle seat to control fuel delivery through a nozzle outlet;

a nozzle control valve for controlling fuel flow into a control chamber through a first passage to pressurise the control chamber, and for controlling fuel flow out of said control chamber through said first passage to depressurise the control chamber;

whereby movement of the nozzle needle is controlled by fuel pressure within the control chamber, such that pressurising the control chamber causes the nozzle needle to be urged against the first needle seat to close the nozzle outlet, and depressurising the control chamber causes the nozzle needle to lift from the first needle seat to open the nozzle outlet;

wherein the nozzle needle defines, at least in part, a restricted passage through which fuel can flow into the control chamber as the control chamber depressurises, the fuel flow into the control chamber through said restricted passage serving to reduce the rate at which the control chamber depressurises, thereby reducing the rate at which the nozzle needle lifts from the first needle seat to open the nozzle outlet and wherein the nozzle needle is resiliently deformable to vary the size of the restricted passage so as to provide a variable flow area that increases as the pressure of fuel supplied to the injector nozzle increases.

7. A fuel injector for use in delivering fuel to an internal combustion engine, the fuel injector comprising:

a nozzle having a nozzle needle which is moveable with respect to a first needle seat to control fuel delivery through a nozzle outlet;

a nozzle control valve for controlling fuel flow into a control chamber through a first passage to pressurise the control chamber, and for controlling fuel flow out of said control chamber through said first passage to depressurise the control chamber;

whereby movement of the nozzle needle is controlled by fuel pressure within the control chamber, such that pressurising the control chamber causes the nozzle needle to be urged against the first needle seat to close the nozzle outlet, and depressurising the control chamber causes the nozzle needle to lift from the first needle seat to open the nozzle outlet;

wherein the nozzle needle defines, at least in part, a restricted passage through which fuel can flow into the control chamber as the control chamber depressurises, the fuel flow into the control chamber through said restricted passage serving to reduce the rate at which the control chamber depressurises, thereby reducing the rate at which the nozzle needle lifts from the first needle seat to open the nozzle outlet; and wherein the restricted passage is defined by an orifice provided in the nozzle needle.

8. The injector of claim 7 wherein the orifice includes an axial drilling and/or a radial drilling.

9. A fuel injector for use in delivering fuel to an internal combustion engine, the fuel injector comprising:

a nozzle having a nozzle needle which is moveable with respect to a first needle seat to control fuel delivery through a nozzle outlet;

a nozzle control valve for controlling fuel flow into a control chamber through a first passage to pressurise the control chamber, and for controlling fuel flow out of said control chamber through said first passage to depressurise the control chamber;

whereby movement of the nozzle needle is controlled by fuel pressure within the control chamber, such that pressurising the control chamber causes the nozzle needle to be urged against the first needle seat to close the nozzle outlet, and depressurising the control chamber causes the nozzle needle to lift from the first needle seat to open the nozzle outlet;

wherein the nozzle needle defines, at least in part, a restricted passage through which fuel can flow into the control chamber as the control chamber depressurises, the fuel flow into the control chamber through said restricted passage serving to reduce the rate at which the control chamber depressurises, thereby reducing the rate at which the nozzle needle lifts from the first needle seat to open the nozzle outlet; and wherein the restricted passage has a flow area that increases as the pressure of fuel supplied to the injector nozzle increases.

10. The injector of claim 9, wherein the restricted passage is substantially annular in cross section.

11. The injector of claim 10, wherein the nozzle needle is resiliently deformable to vary the size of the restricted passage with the pressure of fuel supplied to the injector nozzle.

12. The injector of claim 11, wherein the upper end of the nozzle needle is resiliently deformable, and arranged to contract inwardly to increase the size of the restricted passage when the fuel pressure supplied to the injector nozzle exceeds the pressure in the control chamber.

13. The injector of claim 12, further comprising a cavity in the upper end of the nozzle needle for reducing the structural rigidity of said upper end, wherein the cavity is defined by a resiliently deformable cavity wall which is arranged to contract inwardly when the fuel pressure in the control chamber is reduced.

14. The injector of claim 13, further comprising an additional restricted passage between the control chamber and a region outside the cavity wall, the additional restricted passage being arranged such that, in use, fuel can flow out of the control chamber during pressurisation of the control chamber into the region outside the cavity wall, thereby to substantially equalise the pressures on either side of the cavity wall, and hence limit radial expansion of the cavity wall as the control chamber is pressurised.

15. The injector of claim 14, wherein the additional restricted passage has a fixed flow area.

16. The injector of claim 14, wherein the additional restricted passage is defined, at least in part, by the nozzle needle.

17. The injector of claim 14, wherein the additional restricted passage is defined in part by a substantially flat portion of an outer surface of the upper end of the nozzle needle.

18. A fuel injector for use in delivering fuel to an internal combustion engine, the fuel injector comprising:

a nozzle having a nozzle needle which is moveable with respect to a first needle seat to control fuel delivery through a nozzle outlet;

a nozzle control valve for controlling fuel flow into a control chamber through a first passage to pressurise the control chamber, and for controlling fuel flow out of said control chamber through said first passage to depressurise the control chamber;

a second needle seat with which the nozzle needle engages when the nozzle needle lifts from the first needle seat;

whereby movement of the nozzle needle is controlled by fuel pressure within the control chamber, such that pressurising the control chamber causes the nozzle needle to be urged against the first needle seat to close the nozzle outlet, and depressurising the control chamber causes the nozzle needle to lift from the first needle seat to open the nozzle outlet;

wherein the nozzle needle defines, at least in part, a restricted passage through which fuel can flow into the control chamber as the control chamber depressurises, the fuel flow into the control chamber through said restricted passage serving to reduce the rate at which the control chamber depressurises, thereby reducing the rate at which the nozzle needle lifts from the first needle seat to open the nozzle outlet; and wherein engagement of the nozzle needle with the second needle seat closes the restricted passage to substantially prevent fuel flow into the control chamber through the restricted passage, thereby reducing parasitic losses of fuel during fuel delivery.

* * * * *